United States Patent [19]

Handy et al.

[11] Patent Number: 5,011,449

[45] Date of Patent: Apr. 30, 1991

[54] APPENDAGE MOTION RESPONSIVE DOLL

[75] Inventors: John N. Handy, Long Beach; Sterling S. Spector, Woodland Hills, both of Calif.

[73] Assignee: Mattel, Inc., El Segundo, Calif.

[21] Appl. No.: 498,680

[22] Filed: Mar. 26, 1990

[51] Int. Cl.[5] ..... A63H 3/28

[52] U.S. Cl. ..... 446/297; 446/303; 446/484

[58] Field of Search ..... 446/297, 303, 298, 301, 446/397, 484

[56] References Cited

U.S. PATENT DOCUMENTS

| | | | |
|---|---|---|---|
| 3,162,980 | 12/1964 | Hellman | 446/302 |
| 3,477,169 | 11/1969 | Gardel et al. | 446/301 |
| 3,514,899 | 6/1970 | Boanno et al. | 446/298 |
| 3,685,200 | 8/1972 | Noll | 446/299 |
| 3,755,960 | 9/1973 | Tepper et al. | 446/299 |
| 4,221,927 | 9/1980 | Dankman et al. | 446/175 X |
| 4,249,338 | 2/1981 | Wexler | 446/303 |
| 4,318,245 | 3/1982 | Stowell et al. | 446/303 |
| 4,451,911 | 5/1984 | Klose et al. | 369/31 |
| 4,601,669 | 7/1986 | Hsieh | 446/303 |
| 4,696,653 | 9/1987 | McKeefery | 446/175 |
| 4,799,171 | 1/1989 | Cummings | 364/513 |
| 4,808,142 | 2/1989 | Berliner | 446/301 |
| 4,809,335 | 2/1989 | Rumsey | 381/53 |
| 4,820,236 | 4/1989 | Berliner et al. | 446/484 X |

FOREIGN PATENT DOCUMENTS

| | | | |
|---|---|---|---|
| 2380045 | 9/1978 | France | 446/303 |

*Primary Examiner*—Mickey Yu

*Attorney, Agent, or Firm*—Roy A. Ekstrand

[57] ABSTRACT

An appendage motion responsive doll includes a body having a torso portion and outwardly extending leg and arm appendages as well as a neck and head simulation. The arm appendages are pivotally secured to the torso to permit motion with respect to the torso. The arms are further fabricated in a manner permitting bending or flexing of the arm appendages. One or more bend sensors are supported within one or more of the arms and cooperate with an internally supported voice unit to produce a selected group of sounds corresponding to the degree of arm motion and bending induced by the user.

8 Claims, 1 Drawing Sheet

APPENDAGE MOTION RESPONSIVE DOLL

FIELD OF THE INVENTION

This invention relates generally to vocalizing dolls or similar figures and particularly to those responsive to doll motion or position.

BACKGROUND OF THE INVENTION

The creation of vocalizing dolls provided a substantial increase in the entertainment and amusement value as well as the realism found in play figures and dolls and the like. While a great variety of vocalizing dolls and play figures have been developed, the most common include an internal vocalizing apparatus supported and usually hidden within the doll or toy figure together with one or more activating switches for controlling the vocalizing apparatus. A further refinement of such vocalizing toy figures and dolls occurred with the creation of vocalizing dolls which were responsive to play action, motion, or appendage articulation. In such improved vocalizing dolls, the sound production and often the selection vocalized is influenced or controlled by one or more of the above.

U.S. Pat. No. 8,755,960 issued to Tepper, et al. sets forth a DOLL GIVING PARTICULAR VOCAL RESPONSES ON MOVEMENT OF PARTICULAR APPENDAGES in which a doll includes a hollow body containing a talking mechanism. A selected appendage is movably supported on the body and mechanical coupling means within the body are coupled to the appendage and to the talking mechanism. The motion of the coupled appendage is transmitted through the coupling mechanism to the talking mechanism actuator and produce vocal responses in accordance with the appendage motion.

U.S. Pat. No. 4,318,245 issued to Stowell, et al. sets forth a VOCALIZING APPARATUS for use in a doll in which a speech synthesizer is controlled by a digital controller. A memory within the controller stores information representing the vocabulary of infant-like sounds to be produced. A motion detector such as a gravity actuated switch activates the controller to cause the synthesizer to produce a pattern of sounds corresponding to the position of the doll.

U.S. Pat. No. 4,601,669 issued to Hsieh sets forth a SOUNDING DEVICE FOR DOLLS in which a sound producer is supported within the upper body cavity of a doll. A press cam and resist cam disposed on a common pivotable cam shaft is coupled to the doll's arm. The sound produced upon rotating of the doll's arm is controlled by cam actuation of the switch contacts of the sound producing device.

U.S. Pat. No. 4,696,653 issued to McKeefery sets forth a SPEAKING TOY DOLL in which a voice actuating unit is supported within the doll body and a plurality of switches are distributed about the doll bodY. The selection of vocalized messages is determined by the switch pressed and a general relationship exists between the switch location on the doll body and the type of message produced. A gravity actuated power switch is also supported within the doll body to conserve power by shutting the unit off during periods of inactivity.

U.S. Pat. No. 4,809,335 issued to Rumsey sets forth a SPEECH UNIT FOR DOLLS AND OTHER TOYS in which a speech producing mechanism having the capability of producing a variety of selected words or phrases is coupled to a gravity sensing apparatus which produces an output signal corresponding to the orientation of the sensing apparatus with respect to gravity. Thus, a variety of messages are played or vocalized in response to a variety of positions or orientations of the speech unit.

U.S. Pat. No. 4,808,142 issued to Berliner sets forth a DOLL WITH CONTROLLED MOUTH ACTUATION IN SIMULATED SPEECH in which a doll head is formed of flexible self-supporting material and defines a mouth and surrounding lips. A motor driven actuator is coupled to the mouth and lips to provide lip motion between open and closed positions to simulate speech. A central processing unit and speech synthesizing system are operative during simulated speech motions.

U.S. Pat. No. 4,799,171 issued to Cummings sets forth a TALK BACK DOLL in which a toy figure in the form of a doll contains an acceleration switch which, when closed by moving the doll, momentarily connects a battery to a microcomputer. By means of a microphone and zero crossing counting technique, the microcomputer recognizes certain basic words. A voice synthesizer produces a selected word or group of words in response to predetermined recognized received words to simulate a "talk back" operation of the doll.

U.S. Pat. No. 4,451,911 issued to Klose, et al. sets forth an INTERACTIVE COMMUNICATING TOY FIGURE DEVICE in which an electronic toy doll includes electronic control circuitry responsive to the selection of one of a plurality of switches on the doll housing. The electronic circuitry selects associated vocal messages in response to switch actuation. The message selection permits a problem solution mode of operation in which the user is given a message selected by a weighted probability and the doll responds according to how the user responds to the various switch response operations possible.

U.S. Pat. No. 4,249,338 issued to Wexler sets forth a DOLL WITH SOUND GENERATOR AND PLURAL SWITCH MEANS in which a crying sound generator is supported within a doll body together with a plurality of switches for actuating the sound generator. The switch mechanisms may be operated by manipulating the doll, by giving it a bottle, by changing its diaper or by picking it up and padding its back. In a play sequence, the sound generator continues to produce crying sounds until the appropriate play action has been initiated upon the doll whereupon the crying ceases.

U.S. Pat. No. 4,221,927 issued to Dankman, et al. sets forth a VOICE RESPONSIVE TALKING TOY in which a sound producing and receiving mechanism is located within a toy. In response to a complex sound such as human speech, the toy generates a train of audio pulses. The pulses are pseudorandom with respect to frequency, composition and duration thus simulating speech.

U.S. Pat. No. 3,685,200 issued to Noll sets forth an ELECTRONIC AND MANUALLY ANIMATED TALKING DOLL in which an animated doll is adapted to reproduce a transcribed voice from a tape recording. A mechanism is provided which produces facial motion of the doll timed in relation to the reproduced audio voice.

U.S. Pat. No. 3,514,899 issued to Bonanno, et al. sets forth a DOLL HAVING ELECTRICAL ACTION PRODUCING MECHANISM RESPONSIVE TO ACTUATORS ON SEPARATE ARTICLES in which a doll supports an internal battery power supply and drive motor together with mechanical articulating means coupled between the motor and the doll appendages. The appendage motion is controlled in response to a plurality of actuators on the doll bodY. The actuators are stimulated by the insertion of one of several items such as diaper pins or nursing bottle nipples.

U.S. Pat. No. 3,162,980 issued to Hellman sets forth a TALKING DOLL AND THE LIKE in which a talking mechanism is supported within a doll body. The character of speech produced is controlled by a plurality of switches actuated by motion of a doll appendage such as the arm.

While the foregoing described prior art devices provide some measure of entertainment value in association with vocalizing dolls and toy figures, they are often costly to produce and complex in their operation In addition, many are unable to respond to degrees of motion and play action of the doll figure. There remains, therefore, a need in the art for a vocalizing doll having appendage motion responsive speech production which avoids the high cost and complexity associated with the prior art devices.

SUMMARY OF THE INVENTION

Accordingly, it is a general object of the present invention to provide an improved vocalizing doll or toy figure. It is a more particular object of the present invention to provide an improved vocalizing doll or toy figure which responds to appendage motion and which may be easily manufactured. It is a still more particular object of the present invention to provide an improved vocalizing doll having appendage motion responsiveness which is economical to produce and reliable in use.

In accordance with the present invention, there is provided an appendage motion responsive doll comprising: a torso portion; having at least one first appendage movably joined to the torso portion; a first bend sensor coupled to the appendage responsive to motion thereof; and vocalizing apparatus coupled to the bend sensor for producing a sound pattern corresponding to the degree of bending of the first bend sensor.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
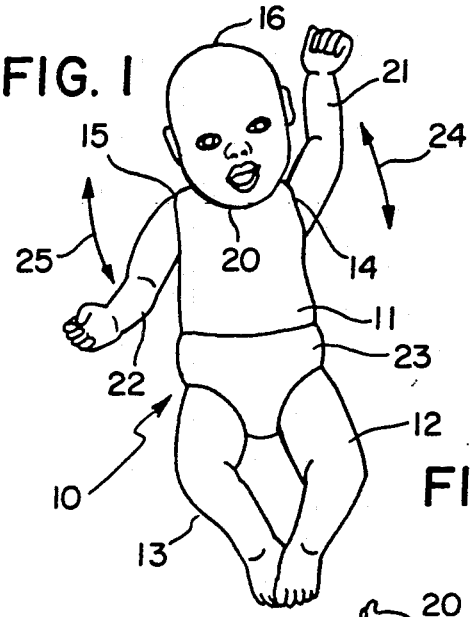
FIG. 1 sets forth the present invention appendage motion responsive doll in a first appendage movement.

FIG. 1 sets forth an appendage motion responsive doll constructed in accordance with the present invention and generally referenced by numeral 10. Doll 10 includes a torso 11 having shoulder portions 14 and 18 and a neck portion 20. A head 16 is supported by neck 20 while a pair of legs 12 and 13 are secured to torso 11 in accordance with conventional fabrication techniques. A diaper 23 encircles a portion of torso 11 and legs 12 and 13 to increase the realism of doll 10. A pair of arms 21 and 22 which are preferably formed of a soft fabric are pivotally secured to shoulders 14 and 15 respectively and in accordance with the invention are movable with respect to torso 11. It will be apparent to those skilled in the art that while doll 10 has been designed to simulate a human infant, the present invention may be utilized by dolls or toy figures having a wide variety of shapes and sizes without departing from the spirit and scope of the present invention. By means set forth below in greater detail, the flexing motions of arms 21 and 22 with respect to torso 11 are sensed by a pair of flex or bend sensors supported therein. While the structure of the vocalizing unit and ben sensors operative within doll 10 are set forth below in greater detail, suffice it to here that in accordance with the present invention the bending or flexing motion of arms 21 and 22 with respect to torso 11 produces a series of vocalized sounds which are varied in accordance with the nature and degree of arm motion and flexing. Thus in the motion depicted in FIG. 1, arms 21 and 22 are depicted as undergoing large rapid arm motion swings in the directions indicated by arrows 24 and 25. As a result, vocalizing unit 40 (seen in FIG. 5) produces a series of laughing sounds in response to the large amplitude fast motion of arms 21 and 22.

Figure 2:
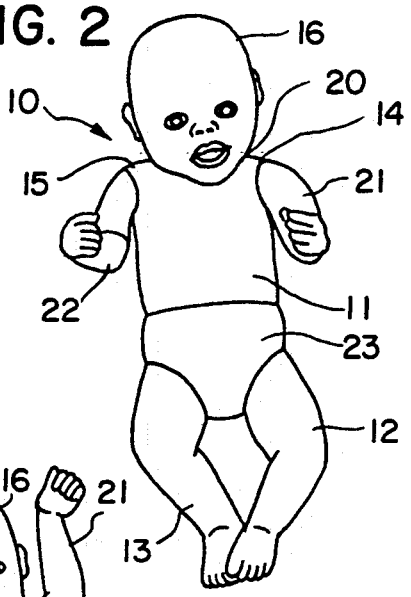
FIG. 2 sets forth the present invention appendage motion responsive doll in a second appendage movement.

FIG. 2 sets forth doll 10 in an alternate mode of operation. As described above, doll 10 includes a torso 11, a neck 20 supporting a head 16 and a pair of shoulder joints 14 and 15. A pair of legs 12 and 18 are secured to torso 11 and covered by a diaper 23. A pair of pivotally movable arms 21 and 22 are secured to shoulder joints 14 and 15 respectively. In the position shown in FIG. 2, arms 21 and 22 are extended forward in a reaching posture and maintained in a relatively still position. In accordance with the invention, voice unit 40 (seen in FIG. 5) responds to the forward position of arms 21 and 22 and the lack of significant motion thereof to produce an alternate series of sounds which replicate the human infant repeatedly uttering "mama".

Figure 3:
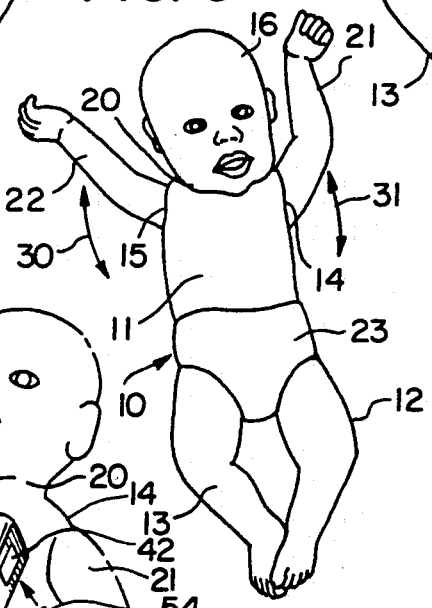
FIG. 3 sets forth the present invention appendage motion responsive doll in a third appendage movement.

FIG. 3 sets forth a still further alternate configuration of doll 10. Doll 10 includes a torso 11, a neck 20, and a pair of shoulder joints 15 and 16. A head 16 is secured to neck 20 and a pair of legs 12 and 13 are secured to torso 11. A diaper 23 covers the junction of legs 12 and 13 to torso 11. In accordance with the invention, a pair of arms 21 and 22 are pivotally joined to shoulder portions 14 and 15. In the position shown in FIG. 3, arms 21 and 22 extend outwardly from torso 11 and undergo slight or small amplitude movements substantially smaller and less violent than those depicted in FIG. 1. Such slight movements in the directions indicated by arrows 31 and 32 cause voice unit 40 to produce a series of audible talking sounds which, in the preferred form, depict the typical baby talk anticipated by human infants.

Figure 4:
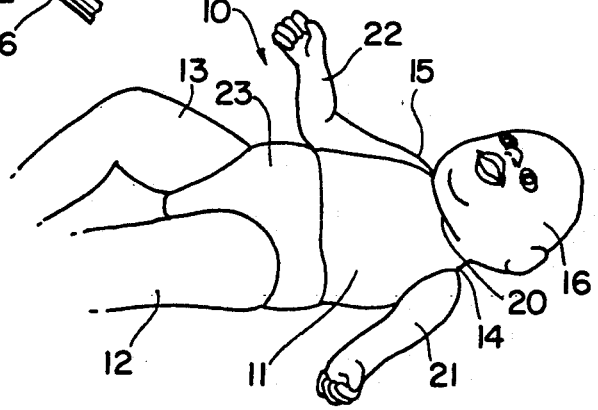
FIG. 4 sets forth the present invention appendage motion responsive doll in a fourth appendage position.

FIG. 4 sets forth the present invention doll 10 in a still further variation of attitude and configuration. Doll 10 includes a torso 11 having a pair of shoulder portions 14 and 15 and a neck portion 20. A head 16 is joined to neck 20 while a pair of legs 12 and 13 are secured to torso 11. The junction of legs 12 and 13 to torso 11 is covered by a simulated diaper 23. A pair of pivotally supported arms 21 and 22 are joined to and supported at shoulders 14 and 15. In the position shown in FIG. 4, arms 21 and 22 are positioned at the sides of doll 10 simulating an infant in a lying down posture. In accordance with the present invention, the position of arms 21 and 22 at the sides of torso 11 and the lack of motion of arms 21 and 22 cause voice unit 40 (seen in FIG. 5) to produce a series of audible sounds depicting the crying of a human infant.

Thus, it can be seen from comparison of FIGS. 1 through 4 that the operation of doll 10 involves the use of a voice unit which responds to sensors within torso 11 and arms 21 and 22 which produce a variety of sounds corresponding to several different types of arm motion in doll 10. Thus in the normal anticipated play action of the user, doll 10 may be guided to respond with seemingly appropriate audible sounds as the user manipulates arms 21 and 22 with respect to torso 11. It will be apparent to those skilled in the art that the variety of arm motion combinations and audible sounds corresponding thereto may be extended or varied from that shown in FIGS. 1 through 4 without departing from the spirit and scope of the present invention.

Figure 5:
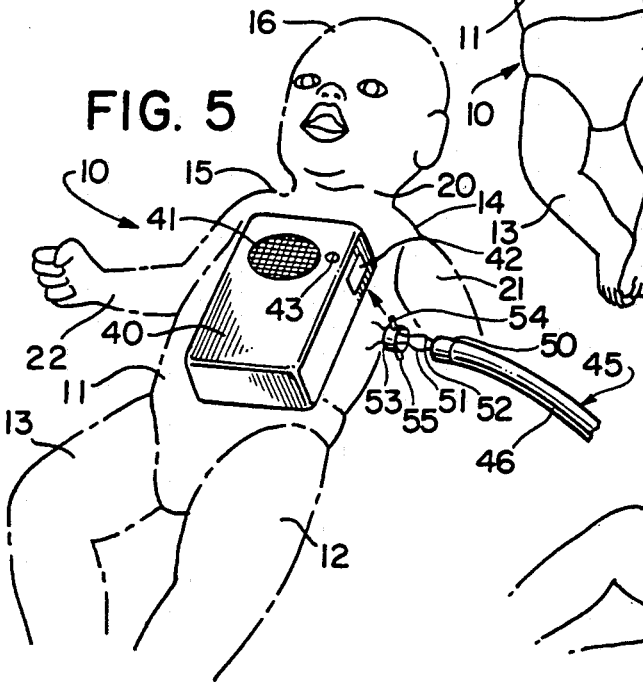
FIG. 5 sets forth a perspective view of the motion sensing portion of the present invention appendage motion responsive doll.

FIG. 5 sets forth a dashed line depiction of doll 10 showing the present invention voice unit and a typical bend sensor used in combination therewith. Accordingly, doll 10 is shown in dashed line representation and includes torso 11. Supported within torso 11 is a generally rectangular voice unit 40 having a speaker 41, an aperture 43 and a slot 42 defined therein. Voice unit 40 includes a conventional speech synthesizer or other appropriate vocalizing instrument which produces a series of audible sounds using speaker 41.

A bend sensor 45 includes an elongated bend transducer 46 terminating in an end collar 50. Bend transducer 46 may be fabricated utilizing any of a wide variety of bend sensing transducers. The essential feature of bend transducer 46 is the change in electrical characteristics thereof as a function of the degree of bending occurring within bend sensor 45. A generally annular support collar 53 defines a pair of outwardly extending tabs 54 and 55. Collar 53 is received within slot 42 and pivotally secured therein by the cooperation of tabs 54 and 55 with apertures 48 and 44 (the latter not seen). A pair of connecting wires 51 and 52 are conductively coupled to bend transducer 46 within bend sensor 45. Wires 51 and 52 extend through support collar 53 and slot 42 to be coupled to the vocalizing apparatus of voice unit 40 (not shown). Bend sensor 45 is assembled within doll 10 by securing end collar 50 within the interior of support collar 53 and thereafter passing support collar 53 through slot 42 and securing tabs 54 and 55 within apertures 43 and 44 (the latter not shown) in voice unit 40. It should be understood that with bend sensor 45 secured in the manner described, bend transducer 46 extends a substantial portion of the length of arm 21. Thus, the movement and bending of arm 21 causes a corresponding movement and bending of bend sensor 45. The bending of sensor 45 in turn produces electrical characteristic changes therein which are communicated to voice unit 40 via connecting wires 51 and 52.

In further accordance with the present invention, a second bend sensor substantially identical to bend sensor 45 is secured to voice unit 40 on the opposite side of slot 42 in the identical manner. This second bend sensor is not shown but should be understood to extend outwardly from voice unit 40 into a substantial portion of arm 22. Thus, bend sensors are supported within arms 21 and 22 to provide the sensing means by which voice unit 40 senses the motion and bending of arms 21 and 22. It will be apparent to those skilled in the art that doll 10 may be fabricated using a single bend sensor for either one of arms 21 or 22 in which case unit 40 would respond solely to that single bend sensor. It will be similarly apparent to those skilled in the art that the use of bend sensors within arms 21 and 22 is a matter of design choice and that alternative arrangements in which the bend sensors are utilized in other appendages may be considered without departing from the spirit and scope of the present invention.

What has been shown is an effective, easy to use and relatively low cost appendage motion responsive doll having one or more bend sensors which permit an internal voice unit to respond to both the degree and direction of arm motion and bending to selectively produce selected sounds from a library of available sounds in general correspondence to the character of arm motion and binding.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. An appendage motion responsive doll comprising:
a torso portion;
a first appendage movably joined to said torso portion;
a first bend sensor coupled to said appendage and responsive to motion thereof; and
vocalizing means capable of producing a plurality of sound patterns coupled to said bend sensor for producing a selected one of said sound patterns corresponding to the degree of bending of said first bend sensor.

2. An appendage motion responsive doll as set forth in claim 1 wherein said doll replicates a human infant having a head, first and second arm appendages and two leg appendages.

3. An appendage motion responsive doll as set forth in claim 2 wherein said first bend sensor is coupled to said first arm appendage.

4. An appendage motion responsive doll as set forth in claim 3 further including a second bend sensor coupled to said second arm appendages.

5. An appendage motion responsive doll as set forth in claim 4 wherein said first and second arm appendages define respective first and second internal arm passages and wherein said bend sensors are received within said first and second arm passages.

6. An appendage motion responsive doll as set forth in claim 5 wherein said first and second bend sensors include elongated bend transducers having a resistance which changes in response to bending.

7. An appendage motion responsive doll as set forth in claim 6 wherein the sounds produced by said vocalizing means to replicate the general responses of a human infant to each type of arm motion used.

8. An appendage motion responsive toy figure comprising:

a primary portion;

a secondary portion movably joined to said primary portion;

a first bend sensor coupled to said secondary portion responsive to motion thereof; and vocalizing means coupled to said bend sensor for producing a sound pattern corresponding to the degree of bending of said first bend sensor.

* * * * *